United States Patent [19]

Shannon, Jr.

[11] 4,310,989

[45] Jan. 19, 1982

[54] TREE STAND

[76] Inventor: Edward J. Shannon, Jr., 3104 Jessica St., Metairie, La. 70003

[21] Appl. No.: 154,061

[22] Filed: May 28, 1980

[51] Int. Cl.[3] ..... A47G 33/12

[52] U.S. Cl. ..... 47/40.5; 248/523; 248/529

[58] Field of Search ..... 248/519, 523, 524, 529, 248/525, 526, 527; 47/40.5

[56] References Cited

U.S. PATENT DOCUMENTS

| | | | |
|---|---|---|---|
| 848,850 | 4/1907 | Pissahl | 248/524 |
| 1,117,158 | 11/1914 | Bernartz et al. | 248/524 |
| 1,496,272 | 6/1924 | Jutz, Sr. | 248/524 |
| 2,484,186 | 10/1949 | Roruik | 248/524 |
| 2,531,117 | 11/1950 | Dyer | 248/529 X |
| 2,617,617 | 11/1952 | Krastel et al. | 47/40.5 |
| 2,630,287 | 3/1953 | Trogdon | 248/523 |
| 2,639,877 | 5/1953 | Fox | 47/40.5 |
| 2,754,075 | 7/1956 | Nelson | 248/523 |
| 3,403,877 | 10/1968 | Gudmundson | 248/523 |

FOREIGN PATENT DOCUMENTS

| | | | |
|---|---|---|---|
| 517609 | 11/1928 | Fed. Rep. of Germany | 248/524 |
| 450093 | 3/1913 | France | 248/523 |
| 141613 | 5/1980 | German Democratic Rep. | 248/523 |

*Primary Examiner*—Steven A. Bratlie

*Attorney, Agent, or Firm*—Harvey B. Jacobson

[57] ABSTRACT

A horizontal base is provided and a pair of edge upstanding and generally parallel clamp panels are supported from the base and engaged therewith for guided movement toward and away from each other relative to the base. Clamp structure is provided and operatively connected between the clamp panels for applying thrust forces thereon to clamp a tree trunk portion therebetween and the opposing sides of the clamp panels include upstanding partial cylindrical recesses for embracing opposite side portions of the tree trunk. The lower marginal portions of the clamp panel include registered downwardly opening notches formed therein and an elongated shallow upwardly opening tray is supported from the base with its opposite end portions received through the notches in the clamp panels.

2 Claims, 3 Drawing Figures

FIG. 1
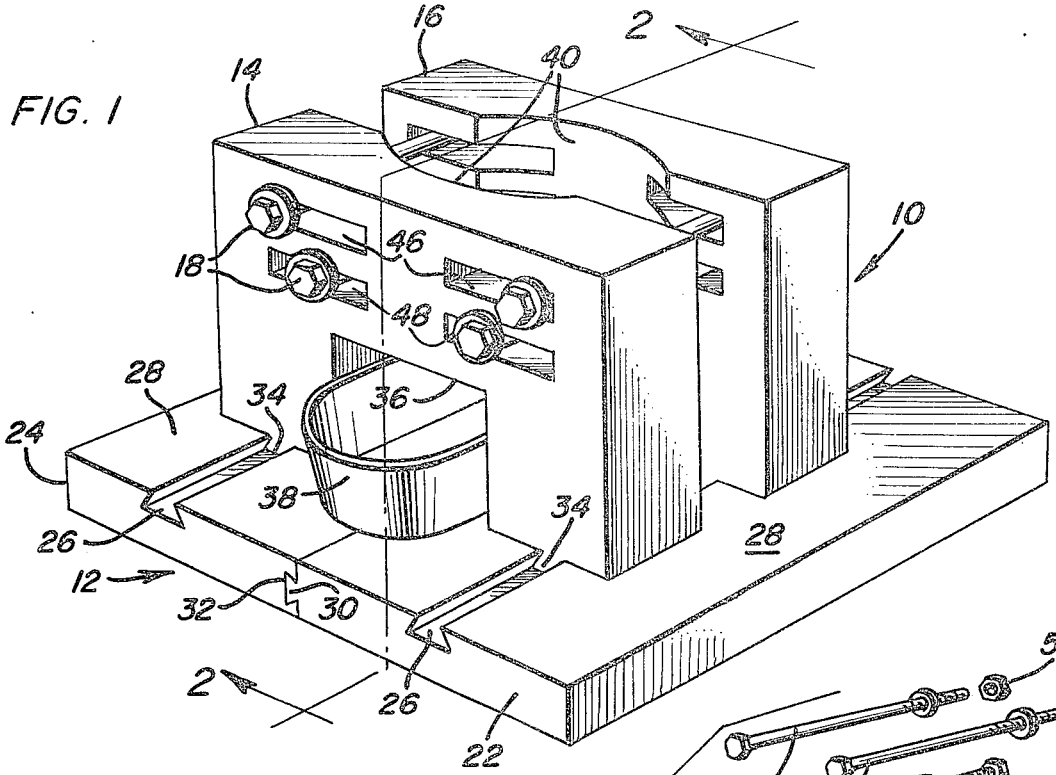
FIG. 2
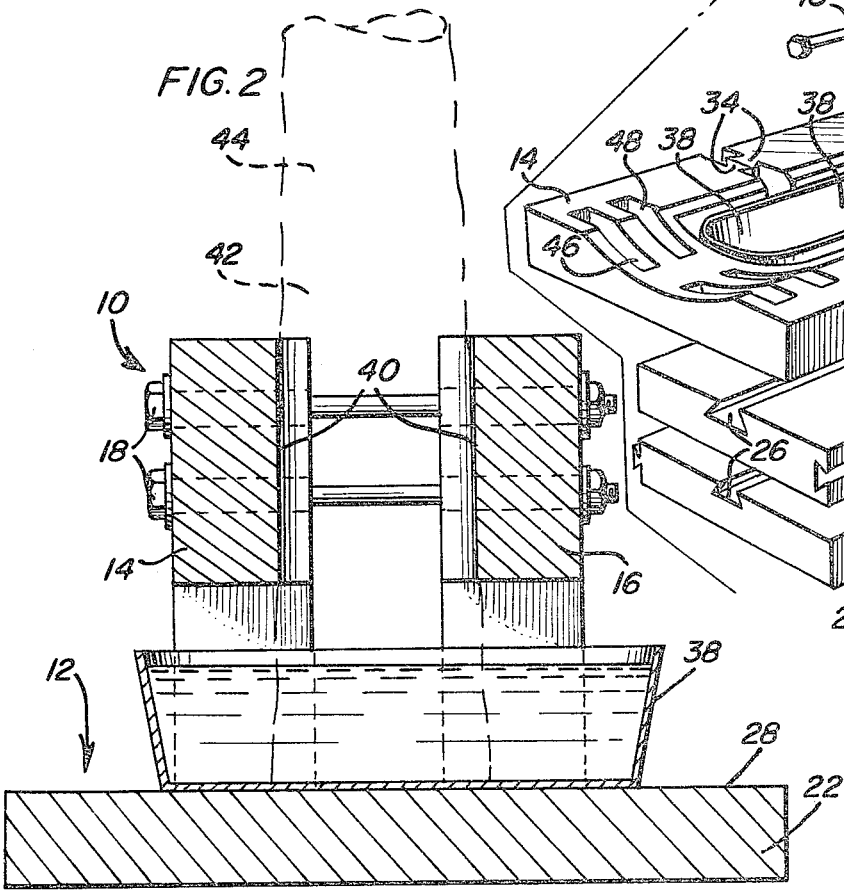
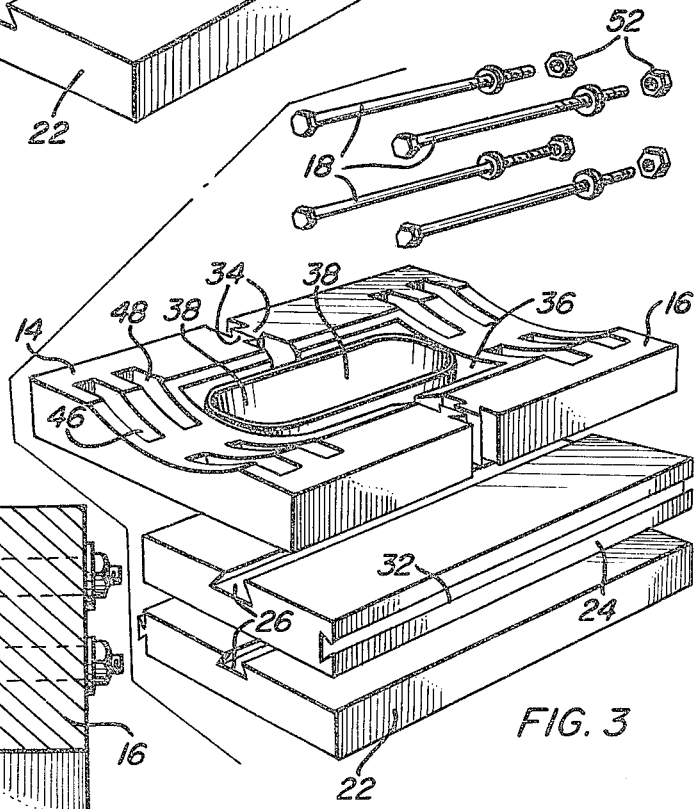
FIG. 3

TREE STAND

BACKGROUND OF THE INVENTION

Various forms of tree stands heretofore have been provided for supporting a Christmas tree in an upright position. However, most previously provided Christmas tree stands are not readily collapsible into a compact state for storage. In addition, most collapsible tree stands do not have a provision for supplying water to the lower end of the trunk of a Christmas tree to prolong its life indoors without excessive dropping of its needles. Accordingly, a need exists for an improved form of collapsible tree stand for use in supporting a Christmas tree in upright position and which may be readily collapsed into a compact state for storage during periods of non-use and yet will also provide water to the lower end of the associated Christmas tree trunk when the stand is in use.

Examples of previously known forms of Christmas tree stands, including some of the general structural and operational features of the instant invention, are disclosed in U.S. Pat. Nos. 1,117,158, 2,531,117, 2,630,287 and 3,403,877.

BRIEF DESCRIPTION OF THE INVENTION

The stand of the instant invention is constructed in a manner whereby the lower or base end of a Christmas tree may be firmly clampingly supported therefrom. In addition, the stand is constructed in a manner whereby it may be readily disassembled and stored in a compact state between Christmas seasons.

The stand includes a horizontal base relative to which a pair of edge upstanding clamp plates are supported for movement toward and away from each other and clamp structure is provided whereby the upstanding clamp plates may be clamped about a tree trunk disposed therebetween. Further, the upstanding clamp plates or panels include registered downwardly opening notches in which the opposite ends of an elongated upwardly opening pan supported from the base and in which the associated tree trunk may be disposed are received. The pan, of course, is provided to contain water whereby the lower end of the associated tree trunk may be immersed in water.

The main object of this invention is to provide a Christmas tree stand which may be readily disassembled and stored in a compact state between Christmas seasons.

Another object of this invention to provide a Christmas tree stand which may be readily utilized in conjunction with Christmas tree trunks of different sizes and also with Christmas tree trunks which may not be vertically straight.

Still another important object of this invention is to provide a readily collapsible and compactly storable Christmas tree stand including features thereof whereby an associated erected Christmas tree may have the base or lower end of the trunk thereof immersed in water.

A final object of this invention to be specifically enumerated herein is to provide a Christmas tree stand in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the Christmas tree stand in assembled condition and operative to clampingly support the base or lower end of a Christmas tree trunk therefrom;

FIG. 2 is an enlarged vertical sectional view taken substantially upon the plane indicated by the section line 2—2 of FIG. 1; and FIG. 3 is an exploded perspective view of the Christmas tree stand in disassembled condition ready for compact storage.

DETAILED DESCRIPTION OF THE INVENTION

Referring now more specifically to the drawings, the numeral 10 generally designates the Christmas tree stand of the instant invention. The stand 10 includes a horizontal base referred to in general by the reference numeral 12 and a pair of upstanding clamp plates 14 and 16 supported from the base 12 and operatively interconnected through the utilization of clamp-type fasteners 18.

The base 12 comprises a pair of side-by-side panels 22 and 24 having parallel dovetail grooves 26 formed in their upper surfaces 28. The marginal edge of the panel 22 adjacent the panel 24 includes a longitudinal dovetail spline 30 and the marginal edge of the panel 24 adjacent the panel 22 includes a dovetail groove 32 in which the spline 30 is interlockingly engaged.

The lower marginal edges of the clamp plates 14 and 16 include longitudinally spaced transversely extending dovetail splines 34 slidingly received in the grooves 26 and the clamp plates 14 and 16 further include central downwardly opening registered notches 36 therein in which the opposite ends of an elongated water tray 38 are received.

The adjacent vertical side surfaces of the clamp plates 14 and 16 include vertically extending partial cylindrical recesses 40 in which to embracingly receive the lower end portion 42 of a Christmas tree trunk 44 and each of the clamp plates 14 and 16 includes upper and lower pairs of slots 46 and 48 in the upper marginal portions thereof through which elongated threaded fasteners 18 are secured by nuts 52 threadedly engaged on the fasteners 18.

The slots 46 and 48 extend into the recesses 40 whereby the clamp plates 14 and 16 are adapted to tightly clamp a small diameter tree trunk lower end portion therebetween and it will be noted that while the clamp plates 14 and 16 engage the tree trunk 44 from one pair of opposite side portions thereof, the fasteners 18 may oppose the outer surfaces of another pair of opposite side portions of the tree trunk 44.

The opposite ends of the tray 38 are received through the notches 36 and, when the stand 10 is disassembled in the manner illustrated in FIG. 3 of the drawings, the panel 24 may be stacked on the panel 22 and the plates 14 and 16 may be disposed on the panel 24 with the notches 36 opening toward each other and embracingly receiving the opposite ends of the tray 38 therebetween, the bottom of tray 38 being positionable on the upper surface of the panel 24. Further, the fasteners 18 may be cradled in the upwardly opening recesses 40. Thus, the stand 10 may be collapsed and stored in an extremely compact state.

During operation, the tight sliding fit of the spline 30 within the groove 32 supports the panels 22 and 24 relative to each other in order to provide a firm base for the tree trunk 44. Also, the tight sliding engagement of the splines 34 within the grooves 26 provides additional bracing between the panels 22 and 24 and the fasteners 18, when the clamp plates 14 and 16 are clamped together opposing opposite sides of the tree trunk 44, and when the fasteners are tightened subsequent to the clamp plates being adjusted relative to the panels 22 and 24 into abutting engagement with opposite sides of a tree trunk disposed therebetween, the thrust forces on the upper marginal portions of the clamp plates 14 and 16 function to angulate the splines 34 in the grooves 26 and thus frictionally resist shifting of the clamp plates 14 and 16 as well as the tree trunk clamped therebetween relative to the panels 22 and 24. Additionally, the fasteners 18 may closely oppose and embrace a second pair of opposite side portions of the tree trunk 44.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A collapsible tree stand, said stand including a horizontal base having opposite side marginal portions, a pair of edge upstanding and generally parallel clamp panels, the opposite ends of the lower marginal edges of said clamp panels and said opposite side marginal portions of said base including coacting releasably engageable anchor means anchoring said clamp panels to said base for guided shifting relative thereto toward and away from each other and against angular displacement of said clamp panels relative to said base, clamp means operatively connected between the upper marginal portion of said clamp panels for applying thrust forces thereon to clamp a tree trunk portion therebetween, said clamp panels defining opposing upstanding generally partial cylindrical recesses for embracing opposite side portions of said trunk portion, said coacting anchor means including a pair of parallel upwardly opening dovetail grooves formed in said base and including at least one pair of ends opening endwise outwardly of the adjacent marginal edge of the base and transverse dovetail splines formed on the lower marginal portions of said clamp panels slidingly received in said grooves, said dovetail grooves and splines being functional to frictionally resist shifting of said clamp panels to said base in response to said thrust forces being applied to said clamp panels at elevations therealong spaced above said base, said clamp means including means operative to apply said thrust forces on areas of said clamp panels spaced above said base, the lower portions of said clamp panels including registered downwardly opening notches formed therein, a shallow elongated water tray, resting on said base and having its opposite ends received in said notches, said clamp means comprising removable clamp-type fasteners extending between and operatively engaged with said clamp panels for drawing the latter toward each other, said clamp panels being positionable, when said stand is disassembled, in horizontal positions superimposed on said base with said partial cylindrical recesses opening upwardly and said notches opening toward and registered with each other, said tray being positionable on said base with the opposite end portions of said tray received in said notches, said clamp-type fasteners, when removed, being receivable in said upwardly opening partial cylindrical recesses.

2. The combination of claim 1 wherein said base comprises a pair of side-by-side horizontal panels, the marginal edge portion of one of said panels opposing the other panel including a dovetail spline extending longitudinally therealong, the longitudinal edge of the other panel opposing said one panel including a horizontally opening dovetail groove formed therein in which said spline is tightly slidingly received, said horizontal panels each having one of said pair of upwardly opening dovetail grooves formed therein.

* * * * *